US007707846B2

(12) United States Patent
Trulaske, Sr. et al.

(10) Patent No.: US 7,707,846 B2
(45) Date of Patent: May 4, 2010

(54) REFRIGERATION UNIT HAVING AN AUDIO PLAYBACK DEVICE

(75) Inventors: Steven L. Trulaske, Sr., St. Louis, MO (US); Steven L. Trulaske, Jr., St. Louis, MO (US)

(73) Assignee: True Manufacturing Co., Inc., O'Fallon, MO (US)

( * ) Notice: Subject to any disclaimer, the term of this patent is extended or adjusted under 35 U.S.C. 154(b) by 0 days.

(21) Appl. No.: 11/470,905

(22) Filed: Sep. 7, 2006

(65) Prior Publication Data

US 2007/0056306 A1 Mar. 15, 2007

Related U.S. Application Data

(60) Provisional application No. 60/715,966, filed on Sep. 9, 2005, provisional application No. 60/793,099, filed on Apr. 19, 2006.

(51) Int. Cl.

| | |
|---|---|
| ***F25D 15/00*** | (2006.01) |
| ***F25D 23/12*** | (2006.01) |
| ***A47G 29/00*** | (2006.01) |
| ***A47B 83/00*** | (2006.01) |

(52) U.S. Cl. ..... 62/331; 248/692; 312/237

(58) Field of Classification Search ..... 62/231, 62/331; 455/344, 348; 248/27.1, 27.3, 689, 248/690, 691, 692, 693; 381/334

See application file for complete search history.

(56) References Cited

U.S. PATENT DOCUMENTS

| | | | | |
|---|---|---|---|---|
| 3,836,221 | A * | 9/1974 | Whistler et al. | 312/237 |
| 5,235,822 | A * | 8/1993 | Leonovich, Jr. | 62/457.2 |
| 6,393,848 | B2 * | 5/2002 | Roh et al. | 62/126 |
| 6,658,323 | B2 * | 12/2003 | Tedesco et al. | 700/236 |
| 6,693,260 | B1 * | 2/2004 | Rodrigues | 219/385 |
| 6,960,127 | B1 * | 11/2005 | Curen | 454/184 |
| 2005/0153749 | A1 * | 7/2005 | Falcon et al. | 455/569.1 |
| 2006/0274910 | A1 * | 12/2006 | Schul et al. | 381/334 |

FOREIGN PATENT DOCUMENTS

| | | | |
|---|---|---|---|
| JP | 2003276476 | A * | 9/2003 |
| JP | 2005142502 | A * | 6/2005 |

* cited by examiner

*Primary Examiner*—Chen-Wen Jiang
(74) *Attorney, Agent, or Firm*—Polster, Lieder, Woodruff & Lucchesi, L.C.

(57) ABSTRACT

A refrigerator having a refrigeration unit comprising a cabinet and a door. The cabinet contains a plurality of items to be cooled or frozen. The refrigerator also includes an audio playback device having a memory and a speaker. The audio playback device is adapted to store a recorded audio soundtrack on the memory and play the recorded audio soundtrack through an audio speaker.

10 Claims, 5 Drawing Sheets

REFRIGERATION UNIT HAVING AN AUDIO PLAYBACK DEVICE

RELATED APPLICATIONS

The present application is claims priority to U.S. Provisional Patent Application No. 60/715,966, filed Sep. 9, 2005, the contents of which are incorporated herein by reference and U.S. Provisional Patent Application No. 60/793,099, filed Apr. 19, 2006, the contents of which are incorporated herein by reference.

FIELD OF THE INVENTION

The invention relates to refrigerators. More specifically, the invention relates to refrigerators that incorporate an audio playback device.

BACKGROUND OF THE INVENTION

Obviously, various types of refrigeration units, such as freezers and coolers, are long known in the art. Many times refrigeration units, some of which have glass doors, are used in retail environments in order to sell products that need to be cooled or frozen. Because the refrigeration unit is being used to sell a product, the more attention that the refrigeration unit gets from passing customers, the greater the likelihood the items inside will be sold. However, in the past, refrigeration units have only incorporated visual effects in order to attract the attention of passing customers. While successful, visual effects will not grab the attention of a busy customer, particularly when the customer has become desensitized to the visual effect due to having seen it many times or due to being placed near competing products also attempting to obtain the customer's attention using a visual effect

SUMMARY OF THE INVENTION

The present invention provides a refrigerator comprising a refrigeration unit comprising a cabinet and a door. The cabinet contains a plurality of items to be cooled or frozen. The refrigerator also comprises an audio playback device comprising a memory and a speaker. The audio playback device is adapted to store a recorded audio soundtrack on the memory and play the recorded audio soundtrack through an audio speaker.

DESCRIPTION OF THE PREFERRED EMBODIMENT

Figure 1:
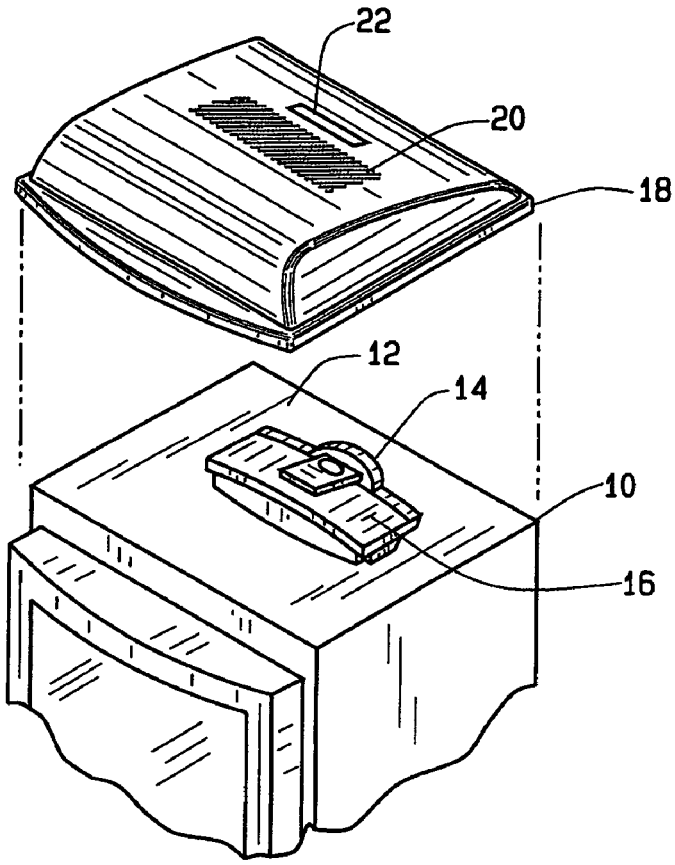
FIG. 1 is an exploded view of a refrigerator according to an embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 3:
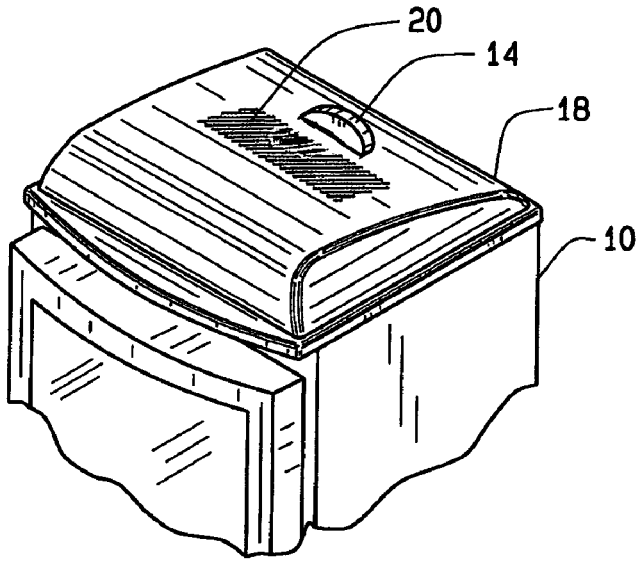
FIG. 3 is a perspective view of a top portion of a refrigerator according to an embodiment of the present invention.
Figure 2:
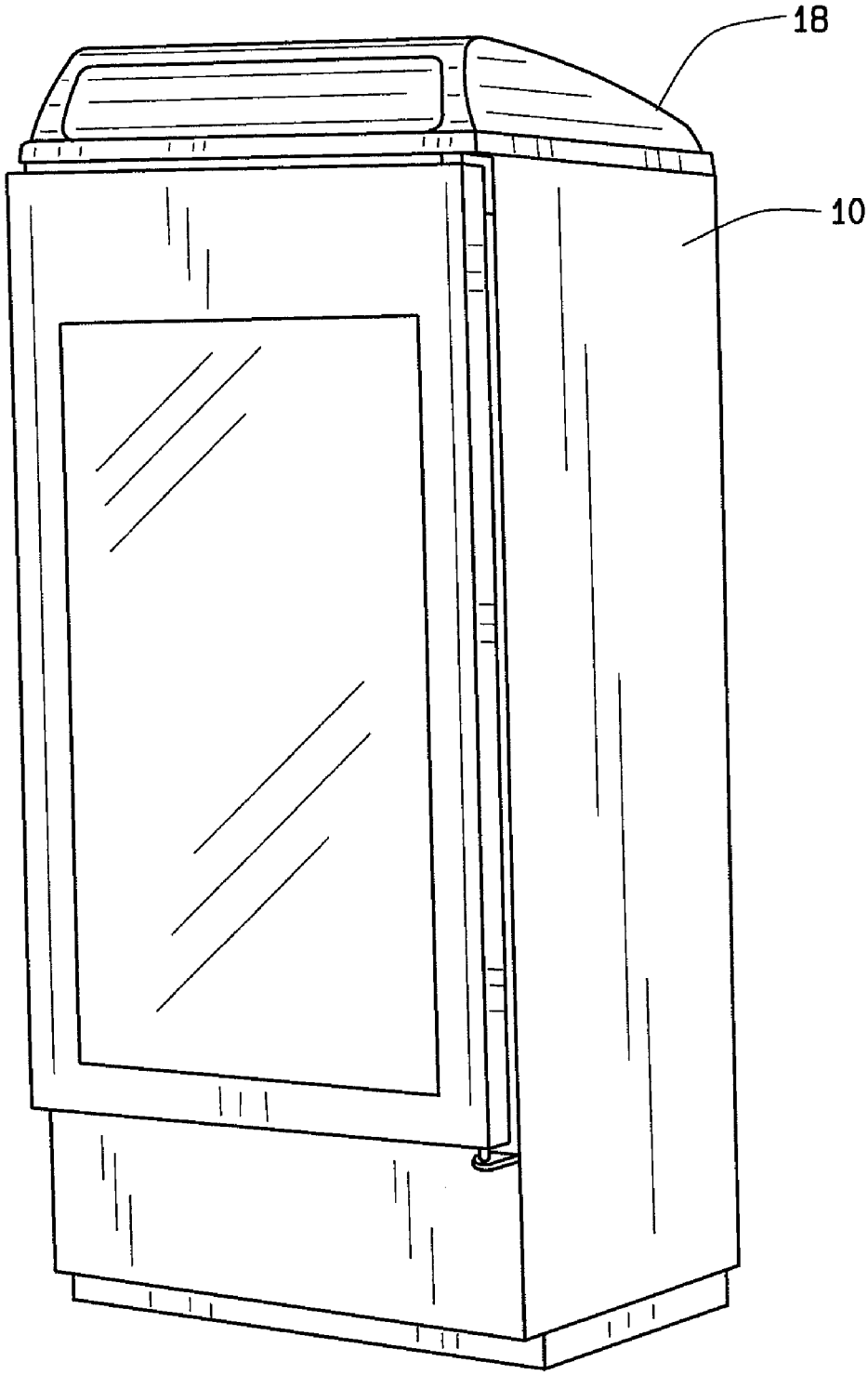
FIG. 2 is a perspective view of a refrigerator according to an embodiment of the present invention.
Figure 4:
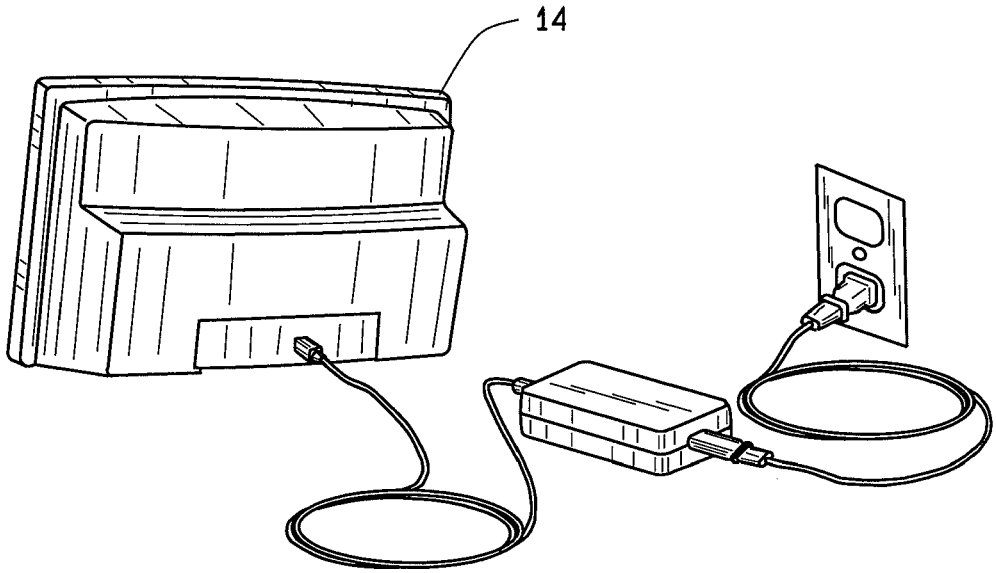
FIG. 4 is a rear view of an audio playback device according to an embodiment of the present invention.

Referring to FIGS. 1-3, the present invention provides a refrigeration unit 10, such as a refrigeration unit model number GDM-10 manufactured by True Manufacturing Co. Inc., the assignee of the present application. The refrigeration unit 10 may also comprise a vending machine. On a top exterior surface of the refrigeration unit 12 is placed an audio playback device 14. The audio playback device 14 is preferably a digital music player incorporating a memory onto which multiple audio tracks or songs may be recorded and is attached to one or more audio speakers. The memory is preferably solid-state memory because it is more resistant to physical shock and vibration while the refrigeration unit is moved and because it is inexpensive and compact. However, the memory may also be a compact hard drive, a compact disc (CD), digital versatile disk (DVD), or a magnetic tape or other known audio storage and playback device.

Figure 5:
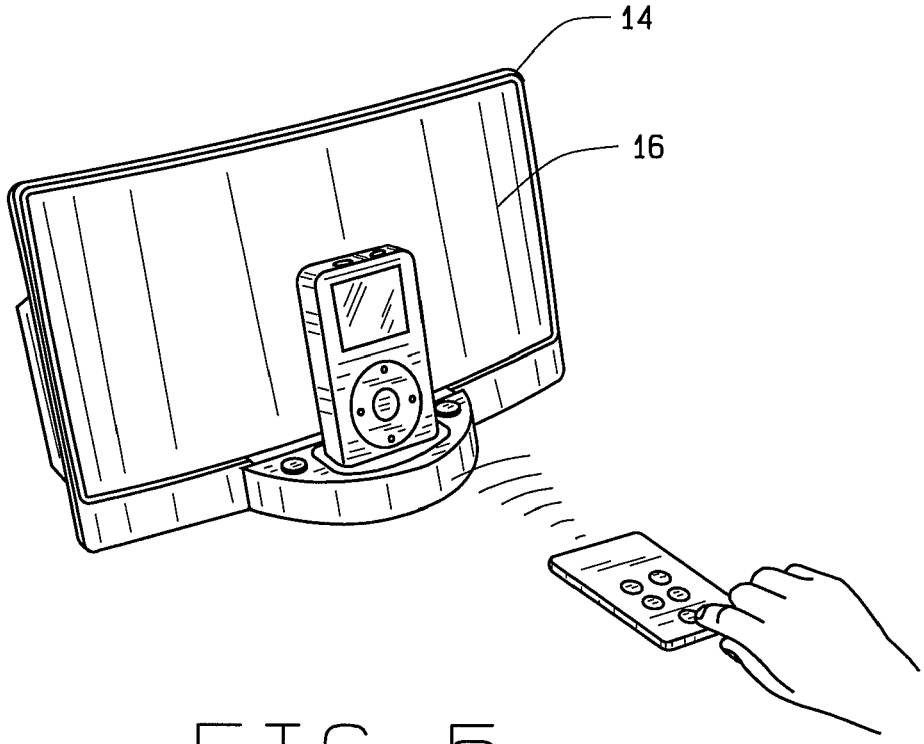
FIG. 5 is a front view of an audio playback device according to an embodiment of the present invention.

Referring to FIG. 5, in the embodiment displayed, the audio playback device 14 comprises an IPOD musical storage system made by Apple Computer, Inc of Cupertino, Calif. Additionally, the audio playback device 14 comprises a BOSE SOUNDDOCK sound transmission system made by Bose Corporation of Framingham, Mass. Alternatively, the audio playback device 14 may constitute a single unitary device comprising a memory and speakers.

The audio playback device 14 is oriented such that its speakers, located on a top surface 16 thereof, are directed upwardly so that sound will be transmitted in all directions. Placed over the audio playback device 14 is cover 18 having a plurality of apertures 20 therein. The apertures are preferably a plurality of circular apertures, but may also be louvers, a single large aperture or other means for allowing sound to transmit through the cover 18 from the audio playback device 14. The audio playback device 14 preferably receives its power from the refrigeration unit 10, although it may be separately powered.

Also provided within the cover 18 is a secondary aperture 22 that allows a portion of the audio playback device 14 to extend therethrough. The portion of the audio playback device 14 extending through the cover 18 has a volume control and various playback controls that allow the volume to be adjusted and the playback mode to be adjusted.

The cover 18 preferably allows sound to clearly transmit therethrough, but also provides security for the audio playback device 14 so that it will not be stolen.

In use, the audio playback device 14 and refrigeration unit 10 are placed in a location where a customer will readily see the refrigeration unit 10 and may also include visual effects which attract a customer's attention. The audio playback device 14 may be programmed to play a certain track repetitively, play a collection of tracks in order or play a collection of tracks randomly. The tracks may include advertising messages, popular music or a combination of the two.

It is further contemplated that the audio playback device can be either manually started and stopped, operate on a time schedule, include a photo sensor and play only when light is detected, a motion sensor and play only when motion near the refrigeration unit is detected, or a door switch which causes the device 14 to play only when the door has or has not been opened within a period of time.

An alternative embodiment not depicted allows more of the audio playback device 14 to extend through the cover 18 so that a user can see a visual display associated with the device 14 and receive the feedback provided through the device 14 to manipulate user controls.

Figure 6:
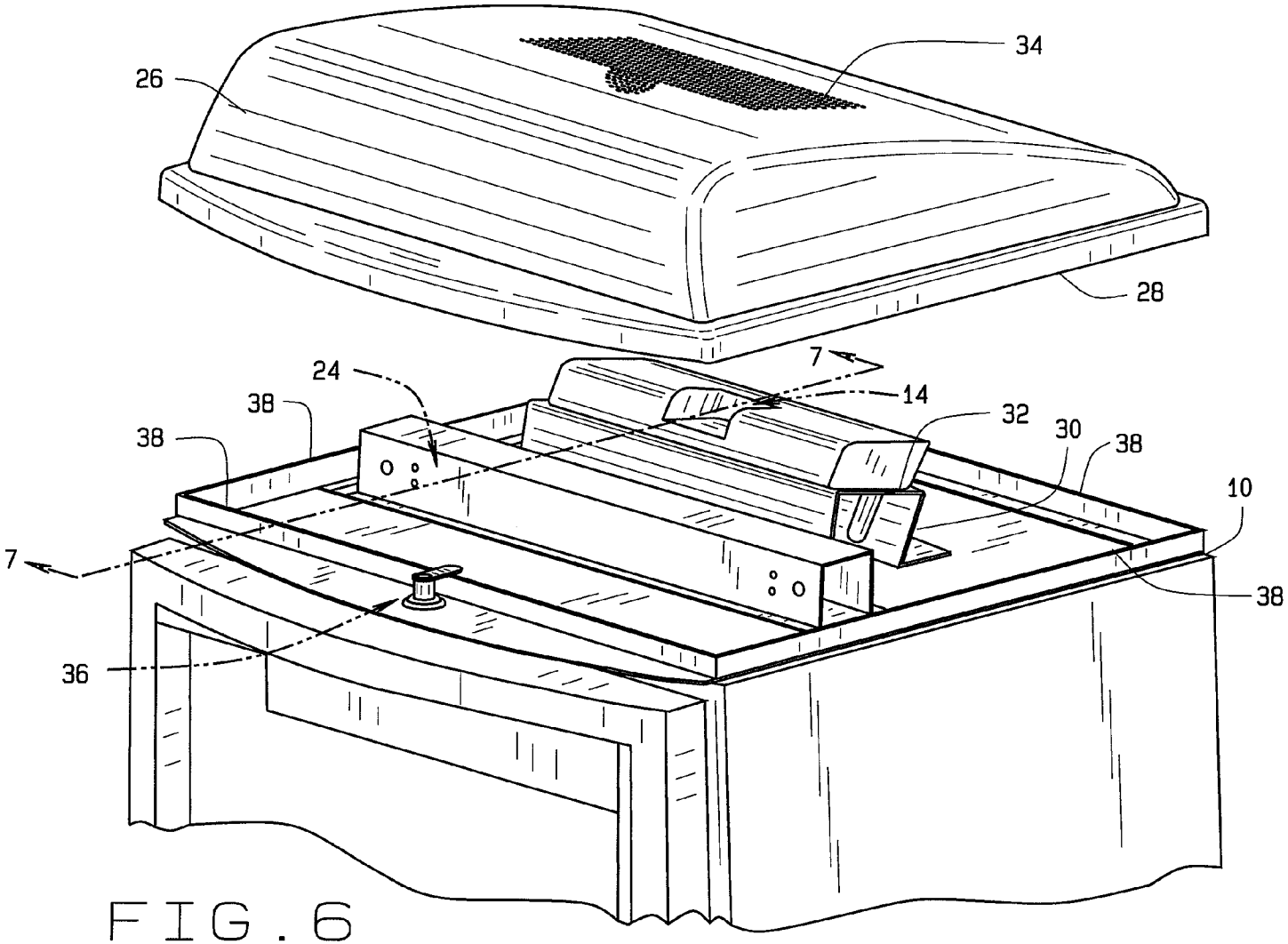
FIG. 6 is a perspective view of an audio playback device mounting system to a refrigeration unit according to an embodiment of the present invention.
Figure 7:
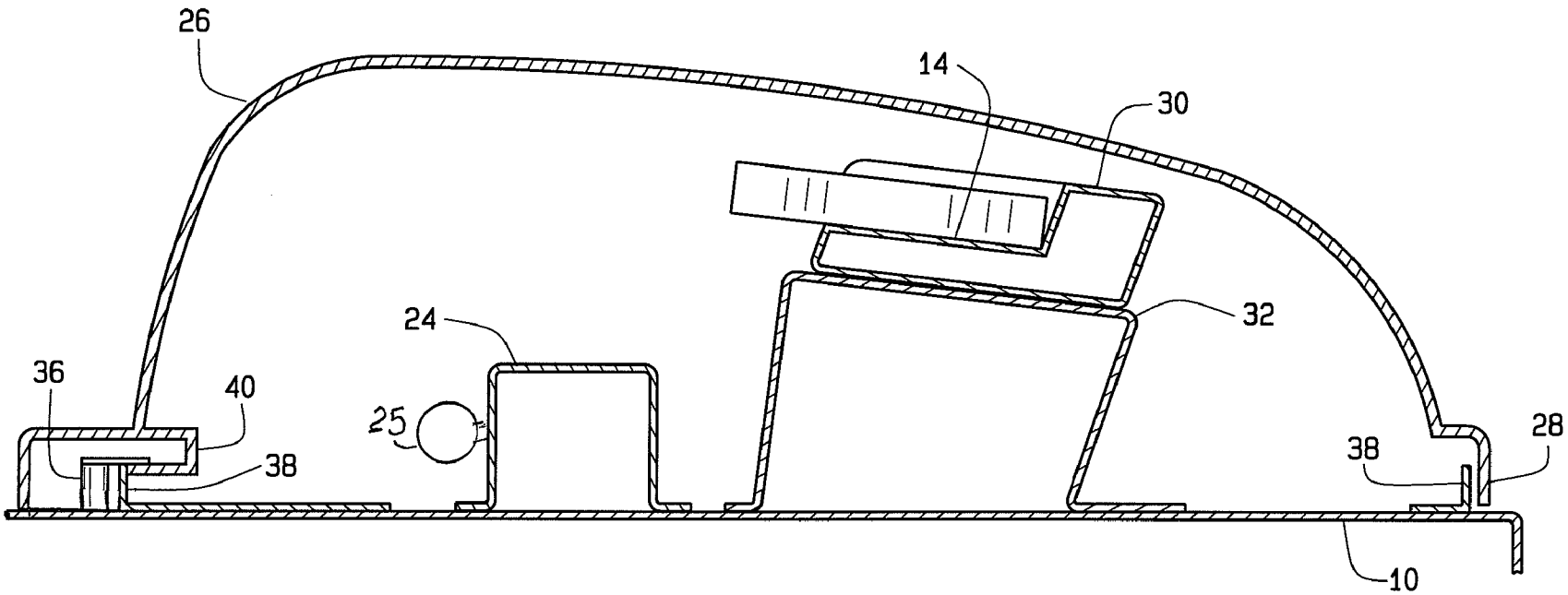
FIG. 7 is a side section view of an audio playback device mounting system to a refrigeration unit according to an embodiment of the present invention.

Referring to FIGS. 6 and 7, an improved system for mounting the audio playback device and light is disclosed. The system includes a first mounting bracket 24 mounted to the top of the refrigeration unit 10. Attached to the mounting bracket 24 is a light 25 (FIG. 7), such as a fluorescent light for lighting a display 26 associated with a cover 28. While the invention is described in terms of a fluorescent light, one of ordinary skill in the art would recognize the other types of lights may be used, such as incandescent lights or light emitting diodes.

A second bracket 30 is mounted to the top of the refrigeration unit 10 rearwardly of the first bracket 24. The second bracket 30 has a recessed top surface 32 upon which the audio playback device 14 is mounted. The top surface 32 is preferably rotated at an angle with respect to the horizontal upper surface of the refrigeration unit 10, such that an audio playback device 14 mounted thereto is pointed upwardly at a slight angle. In this manner, the audio playback device 14 being rotated with respect to the flat upper surface of the refrigeration unit 10 will project sound further from the refrigeration unit and through the cover 28.

The cover 28 defines a plurality of apertures 34 in an upper surface, which allows sound from the audio playback device 14 to travel unobstructed to a listener located near the refrigeration unit 10. A lock 36 is also mounted upon the top of the refrigeration unit 10, which locks a lock extension tab 40 of the cover 28 to the refrigeration unit 10 to secure the audio playback device 14 from theft. L-channel constituting a protrusion 38 is further mounted to the top of the refrigeration unit 10 to provide a mounting flange for the cover 28 to prevent the cover from it sliding to the left or the right or forward or rearward after it has been locked to the refrigeration unit 10. The cover 28 may also be attached to the protrusion 38 by a fastener.

The refrigerator is made with a special plastic cabinet top, shaped in such a manner, as to enclose the lighting of an advertising sign and the IPOD sound system.

The refrigerator has electrical power on top of the cabinet for the fluorescent lighting ballast. The BOSE SOUNDDOCK system is electrically connected, so that it is permanently connected. A sheet metal bracket holds the BOSE SOUNDDOCK system at a determined angle, so that it is pointed upward, against the vacuum-formed plastic cabinet top. The bracket is fastened with screws to the cabinet top. The cabinet top has several hundred apertures drilled into it, to allow the sound through. This area of apertures is aligned with the speaker. In the cabinet top, there is also a rectangular hole, which allows the BOSE SOUNDDOCK system through. The IPOD is then pushed into the BOSE SOUNDDOCK system, which allows for continuous music, as the Bose system maintains battery life. This BOSE SOUNDDOCK system also has volume control, where the customer can increase or decrease the volume. The IPOD can also be removed for safe storage and/or re-programming While the specific embodiments have been illustrated and described, numerous modifications come to mind without significantly departing from the spirit of the invention, and the scope of protection is only limited by the scope of the accompanying claims.

We claim:

1. A refrigerator comprising:

a refrigeration unit comprising a cabinet and a door, the cabinet adapted to contain a plurality of items to be cooled or frozen;

an upwardly extending mounting bracket attached to the top of the cabinet and having a light attached thereto, the light directed toward the front of the cabinet;

an audio playback device comprising a memory and a speaker, the audio playback device adapted to store a recorded audio soundtrack on the memory and play the recorded audio soundtrack through an audio speaker, the audio playback device being mounted to a flange attached to the top of the cabinet, the flange extending upwardly from the top by two legs, the legs adapted to mount the audio playback device at an oblique angle with respect to the top of the cabinet, the flange and the audio playback device disposed rearwardly from the light on the cabinet;

a cover that covers the audio playback device and protects it from tampering wherein the audio device and the user interface are contained within the cover; and an upwardly turned protrusion extending from the top of the cabinet around substantially all of the periphery and around the audio playback device and the light to cooperate with and locate the cover.

2. The refrigerator of claim 1 wherein the audio playback device comprises a single unitary device.

3. The refrigerator of claim 1 wherein the cover comprises a plurality of apertures that are adapted to allow sound to pass through the cover.

4. The refrigerator of claim 1 wherein the cover comprises a tab to cooperate with a lock mounted to the cabinet to restrict removal of the cover.

5. The refrigerator of claim 1 wherein the memory is solid-state memory.

6. The refrigerator of claim 1 wherein the memory comprises a hard drive.

7. The refrigerator of claim 1 wherein the audio playback device is mounted to the cabinet by a bracket, the bracket adapted to hold the audio playback device at a non-horizontal angle.

8. A refrigerator comprising:

a refrigeration unit comprising a cabinet and a clear glass door, the cabinet adapted to contain a plurality of items to be cooled or frozen;

an upwardly extending mounting bracket attached to the top of the cabinet and having a light attached thereto, the light directed toward the front of the cabinet;

an audio playback device comprising solid state memory and a speaker, the audio playback device adapted to store a recorded audio soundtrack on the memory and play the recorded audio soundtrack through an audio speaker, the audio playback device is mounted to a flange attached to on the top of the cabinet, the flange extending upward from the top by two legs, the legs adapted to mount the audio playback device at an oblique angle with respect to the top of the cabinet, the flange and the audio playback device disposed rearwardly from the light on the cabinet;

a cover mounted to the top of the cabinet that comprises a plurality of apertures that are adapted to allow sound to pass through the cover; and an upwardly turned protrusion extending from the top of the cabinet around substantially all of the periphery and around the audio playback device and the light to cooperate with and locate the cover.

9. The refrigerator of claim 8 wherein the audio playback device comprises a single unitary device.

10. The refrigerator of claim 8 wherein the cover comprises a tab to cooperate with a lock mounted to the cabinet to restrict removal of the cover.

* * * * *